US012662845B2

(12) United States Patent
Wang

(10) Patent No.: US 12,662,845 B2
(45) Date of Patent: Jun. 23, 2026

(54) FOLDABLE TENT INTEGRATED WITH EAVES AND USING METHOD THEREFOR

(71) Applicant: XIAMEN MOQI INDUSTRY AND TRADE CO., LTD., Xiamen City (CN)

(72) Inventor: Xingling Wang, Xiamen City (CN)

(73) Assignee: XIAMEN MOQI INDUSTRY AND TRADE CO., LTD., Xiamen City (CN)

( * ) Notice: Subject to any disclaimer, the term of this patent is extended or adjusted under 35 U.S.C. 154(b) by 231 days.

(21) Appl. No.: 18/621,335

(22) Filed: Mar. 29, 2024

(65) Prior Publication Data

US 2024/0360689 A1 Oct. 31, 2024

(30) Foreign Application Priority Data

Apr. 27, 2023 (CN) ..... 202310471406.7

(51) Int. Cl.
*E04H 15/58* (2006.01)
*E04H 15/50* (2006.01)

(52) U.S. Cl.
CPC ..... *E04H 15/58* (2013.01); *E04H 15/50* (2013.01)

(58) Field of Classification Search
CPC ..... E04H 15/58; E04H 15/50; E04H 15/48; E04H 15/32
USPC ..... 135/120.2, 120.3, 131, 145, 117
See application file for complete search history.

(56) References Cited

U.S. PATENT DOCUMENTS

| | | | | |
|---|---|---|---|---|
| 7,066,676 | B2 * | 6/2006 | Tsai | F16B 7/042 403/379.2 |
| 8,544,489 | B2 * | 10/2013 | Choi | E04H 15/50 135/147 |
| 8,590,553 | B2 * | 11/2013 | Lovley, II | E04H 15/50 135/120.2 |
| 8,701,692 | B2 * | 4/2014 | Holland | E04H 15/50 135/145 |
| 9,528,292 | B1 * | 12/2016 | Lovley, II | E04H 15/50 |
| 9,739,073 | B2 * | 8/2017 | Huang | E04H 15/50 |
| 9,926,720 | B2 * | 3/2018 | Huang | E04H 15/54 |
| 10,072,439 | B2 * | 9/2018 | Lovley, II | E04H 15/46 |
| 10,280,645 | B1 * | 5/2019 | Yang | E04H 15/50 |

(Continued)

FOREIGN PATENT DOCUMENTS

WO WO-2023185730 A1 * 10/2023 ..... E04H 15/46

*Primary Examiner* — Robert Canfield

(57) ABSTRACT

Disclosed are a foldable tent integrated with eaves and a using method therefor. The foldable tent integrated with eaves includes transverse supporting assemblies, where longitudinal supporting assemblies are arranged between the transverse supporting assemblies, joints between the transverse supporting assemblies and the longitudinal supporting assemblies are provided with connectors, the transverse supporting assemblies are movably connected to the longitudinal supporting assemblies through the connectors, and one side of one transverse supporting assembly is provided with an extended eaves assembly; and vertical supporting assemblies are arranged on two sides of two longitudinal supporting assemblies, the vertical supporting assemblies include supporting sleeve rods and inner supporting rods, and one ends of the inner supporting rods extend into the supporting sleeve rods. The effect of sheltering from sun and preventing rainwater from invading into the tent is realized, an area covered by the tent is expanded, and rainwater accumulation is avoided.

7 Claims, 12 Drawing Sheets

(56) References Cited

U.S. PATENT DOCUMENTS

D854,107 S * 7/2019 Choi ..... D21/834
D859,564 S * 9/2019 Choi ..... D21/839
11,072,943 B2 * 7/2021 Sun ..... E04H 15/32
D970,675 S * 11/2022 Ying ..... D21/839
12,037,808 B2 * 7/2024 Sun ..... E04H 15/50
12,084,879 B2 * 9/2024 Yang ..... E04H 15/54
12,104,398 B2 * 10/2024 Sun ..... E04H 15/46
12,139,926 B2 * 11/2024 Lu ..... E04H 15/48
12,258,773 B2 * 3/2025 Choi ..... E04H 15/50
12,404,696 B2 * 9/2025 Grace ..... E04H 15/50
2002/0092555 A1 * 7/2002 Chen ..... E04H 15/50 135/144
2007/0012346 A1 * 1/2007 Choi ..... F16B 7/105 135/120.3
2011/0073148 A1 * 3/2011 Choi ..... E04H 15/50 135/144
2014/0099155 A1 * 4/2014 Chen ..... E04H 15/46 403/83
2014/0130837 A1 * 5/2014 Sy-Facunda ..... E04H 15/50 135/120.3
2015/0376913 A1 * 12/2015 Choi ..... E04H 15/50 135/147
2017/0121999 A1 * 5/2017 Ma ..... E04H 15/42
2019/0292808 A1 * 9/2019 Dotterweich ..... E04H 15/02
2022/0018152 A1 * 1/2022 Dotterweich ..... E04H 15/18
2023/0295951 A1 * 9/2023 Choi ..... E04H 15/50 135/143
2024/0318457 A1 * 9/2024 Wang ..... E04H 15/58
2024/0318458 A1 * 9/2024 Wang ..... E04H 15/16
2024/0376743 A1 * 11/2024 Wang ..... E04H 15/48
2025/0101766 A1 * 3/2025 Song ..... E04H 15/46
2025/0163722 A1 * 5/2025 Zheng ..... E04H 15/50
2025/0230680 A1 * 7/2025 Huang ..... E04H 15/50
2025/0347140 A1 * 11/2025 Yuan ..... E04H 15/18

* cited by examiner

FOLDABLE TENT INTEGRATED WITH EAVES AND USING METHOD THEREFOR

CROSS REFERENCE TO RELATED APPLICATION

This application claims priority benefit of Chinese Patent Application No. 202310471406.7, filed on Apr. 27, 2023, and the entire content of which is incorporated herein by reference.

TECHNICAL FIELD

The disclosure relates to the technical field of tents, and in particular to a foldable tent integrated with caves and a using method therefor.

BACKGROUND

A tent is a common tool to shelter from sun and rain when people get together for leisure activities on squares, beaches, lawns, etc. It provides a comfortable space for people to enjoy outdoor leisure activities, and is popular among consumers. Being convenient to carry and store, a foldable tent is especially popular.

Since an existing tent is equipped without extended caves, after the tent is set up, a shadow area covered by the tent will be narrowed by oblique sunlight. Moreover, rainwater is likely to be accumulated at a top of the tent in rainy days, which affects user experience.

SUMMARY

In view of that, the disclosure provides a foldable tent integrated with caves and a using method therefor. Accordingly, the problems that a shadow area covered by a tent is small, and rainwater is likely to be accumulated at a top of the tent are solved.

In order to realize the above objective, the disclosure provides the technical solutions as follows.

A foldable tent integrated with eaves includes transverse supporting assemblies, where longitudinal supporting assemblies are arranged between the transverse supporting assemblies, the transverse supporting assemblies are movably connected to the longitudinal supporting assemblies, and one side of one transverse supporting assembly is movably provided with an extended eaves assembly; vertical supporting assemblies are arranged at end portions of the transverse supporting assemblies, the vertical supporting assemblies include supporting sleeve rods and inner supporting rods, one ends of the inner supporting rods extend into the supporting sleeve rods, and the end portions of the transverse supporting assemblies are provided with linking mechanisms.

The linking mechanisms include fixed bases and movable bases, where the movable bases include buttons and second leaf springs, top ends of the supporting sleeve rods are snapped into the fixed bases, the fixed bases are fixed to the supporting sleeve rods, the supporting sleeve rods are snapped into the movable bases, and the movable bases are slidably connected to the supporting sleeve rods; and the second leaf springs are arranged inside the supporting sleeve rods, second limiting holes are provided on one sides of the supporting sleeve rods, one ends of the second leaf springs extend out of the second limiting holes, and the buttons are arranged on one sides of the movable bases to correspond to the second limiting holes.

The transverse supporting assemblies include a plurality of first connection rods, where the first connection rods are cross-pivoted to form first connection rod assemblies, the first connection rod assemblies are movably connected to one another, and two ends of the transverse supporting assembly are movably connected to the fixed bases and the movable bases individually.

The longitudinal supporting assemblies include a plurality of second connection rods, and the second connection rods are movably connected to each other in a crossed manner; and longitudinal supporting assemblies positioned on inner sides are movably connected to the first connection rods individually, and longitudinal supporting assemblies positioned on outer sides are movably connected to the fixed bases and the movable bases individually.

The extended caves assembly, the fixed bases, and the longitudinal supporting assemblies are movably connected to connectors.

The extended caves assembly includes third connection rods arranged on two sides, and front ends of the third connection rods are connected to each other in a crossed manner; and a third connection rod on one side is movably connected to the first connection rod through a connector, a third connection rod on the other side is movably connected to the fixed base through a connector, the third connection rod on the one side is connected to a fourth connection rod through a rotary shaft, and the fourth connection rod is movably connected to the movable base through a connector.

The front ends of the third connection rods are connected to each other in the crossed manner through connectors.

The longitudinal supporting assemblies positioned on the inner sides are movably connected to the first connection rods through connectors individually.

Joints between the inner supporting rods and the supporting sleeve rods are provided with connection housings, the inner supporting rods are internally provided with first leaf springs, and one sides of the inner supporting rods are provided with plugs; and the plugs extend into the inner supporting rods, one sides of the supporting sleeve rods are provided with a plurality of first limiting holes, and one ends of the first leaf springs extend out of the first limiting holes.

The other side of the one transverse supporting assembly is further movably provided with an extended caves assembly.

A using method for a foldable tent integrated with eaves includes.

- S1, unfolding transverse supporting assemblies and longitudinal supporting assemblies.
- S2, unfolding an extended eaves assembly on one side of one transverse supporting assembly to position the extended eaves assembly in an oblique state.
- S3, stretching vertical supporting assemblies on one side corresponding to the extended eaves assembly in response to determining that the extended eaves assembly is positioned in an upwards-oblique state, so that the one side of the tent has a greater height than the other side; and retracting vertical supporting assemblies on one side corresponding to the extended eaves assembly in response to determining that the extended eaves assembly is positioned in a downwards-oblique state, so that the one side of the tent has a lower height than the other side.

Embodiments of the disclosure have the advantages as follows.

The fixed bases and the movable bases support the tent, so that the extended caves assemblies are stabler when being unfolded. The extended caves assemblies extend beyond the transverse supporting assembly, so that waterproof rain cloth laid extends beyond the transverse supporting assemblies. Accordingly, the effect of sheltering from sun and preventing rainwater from invading into the tent in rainy days is realized, an area covered by the tent is expanded, and rainwater accumulation is avoided.

BRIEF DESCRIPTION OF FIGURES

In order to describe the technical solutions in the implementation of the disclosure or the prior art more clearly, the accompanying drawings required for describing the implementation or the prior art will be briefly described below. Obviously, the accompanying drawings in the following description are merely illustrative. Those of ordinary skill in the art can also derive other implementation accompanying drawings from the accompanying drawings provided without creative efforts.

The structure, proportion, size, etc. shown in the description are merely used to jointly explain the contents disclosed in the description for understanding and reading by those skilled in the art, are not intended to limit the restrictive conditions implementable by the disclosure, and thus have no technical substantive meanings. Without affecting the effect and objectives realizable by the disclosure, any structural modification, proportion relation change, or size adjustment should still fall within the scope that the technical contents disclosed in the disclosure can cover.

Figure 1:
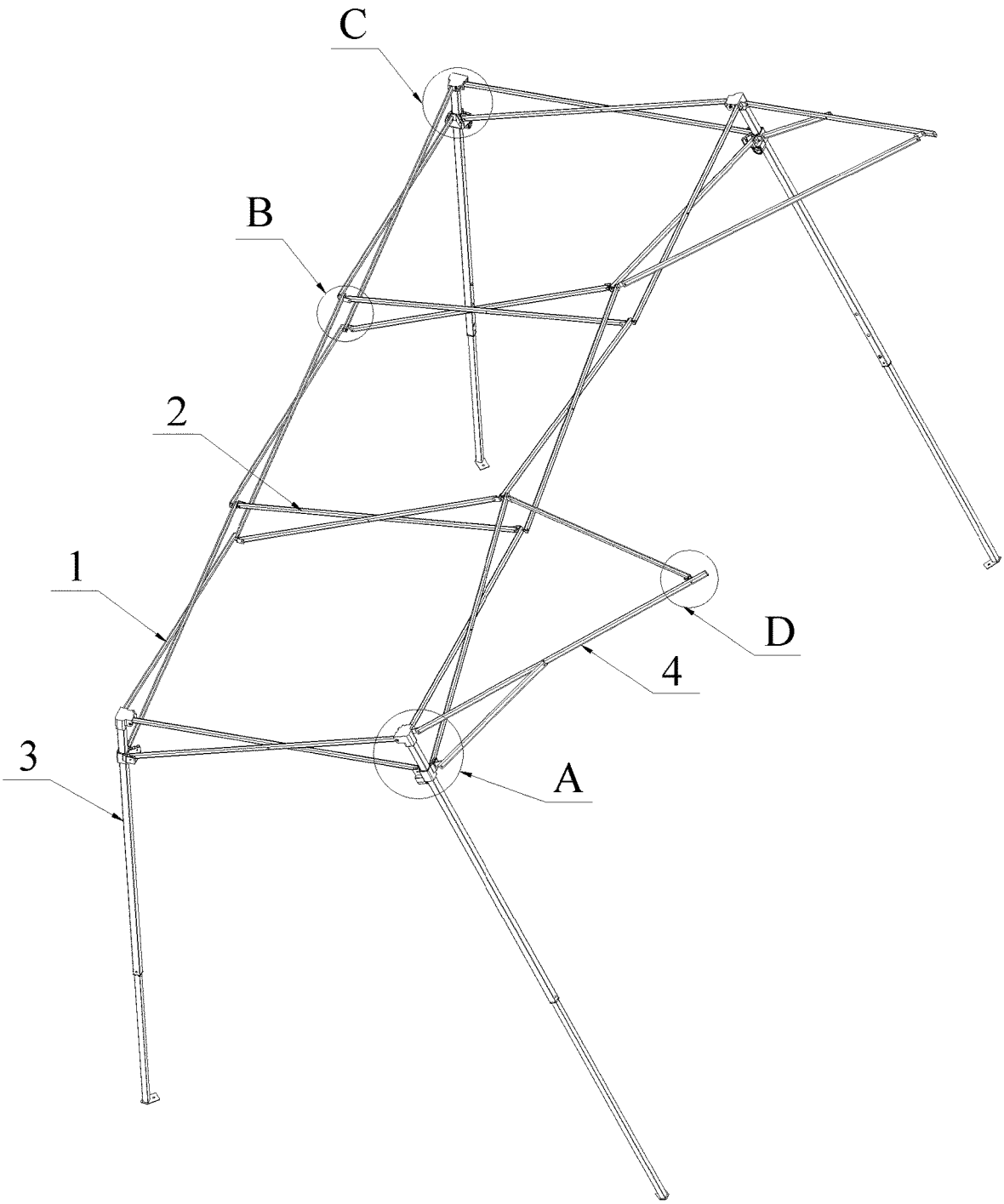
FIG. 1 is an overall schematic structural diagram of the present disclosure.
Figure 2:
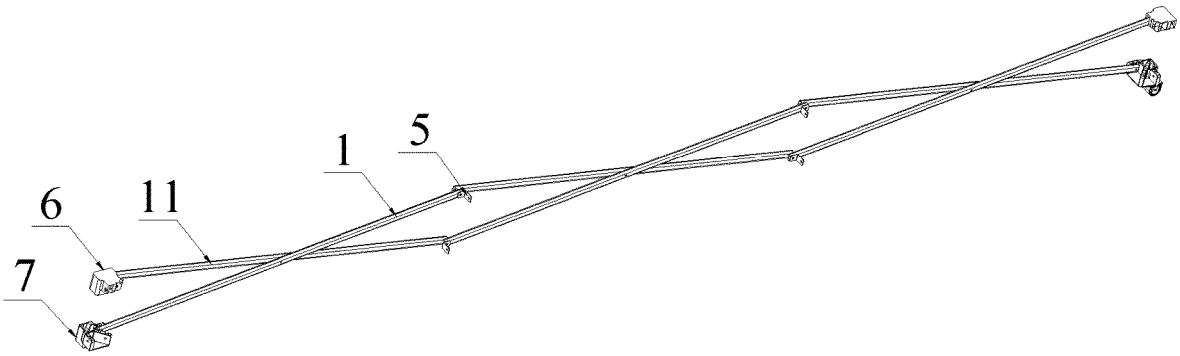
FIG. 2 is a solid diagram of a transverse supporting assembly according to the disclosure.
Figure 3:
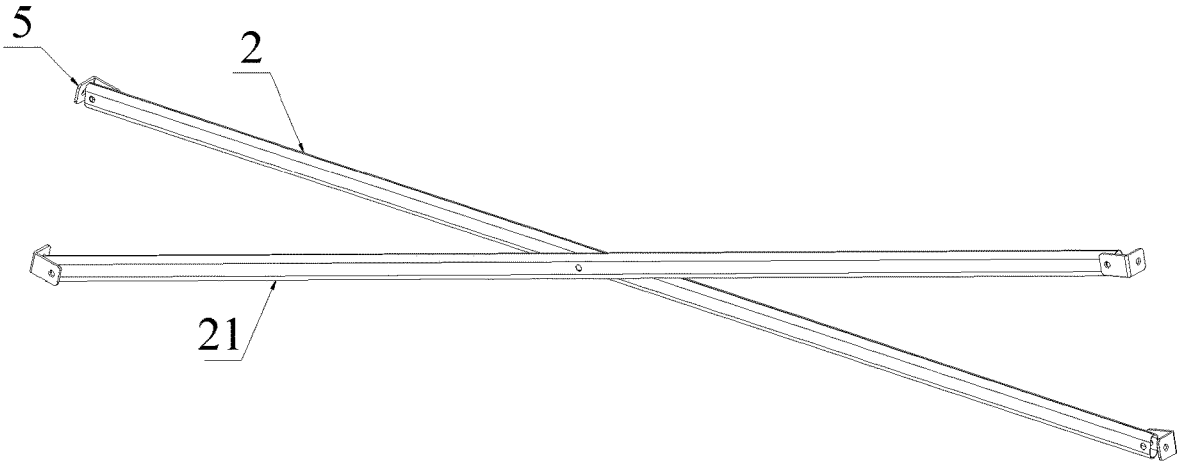
FIG. 3 is a solid diagram of a longitudinal supporting assembly according to the disclosure.
Figure 4:
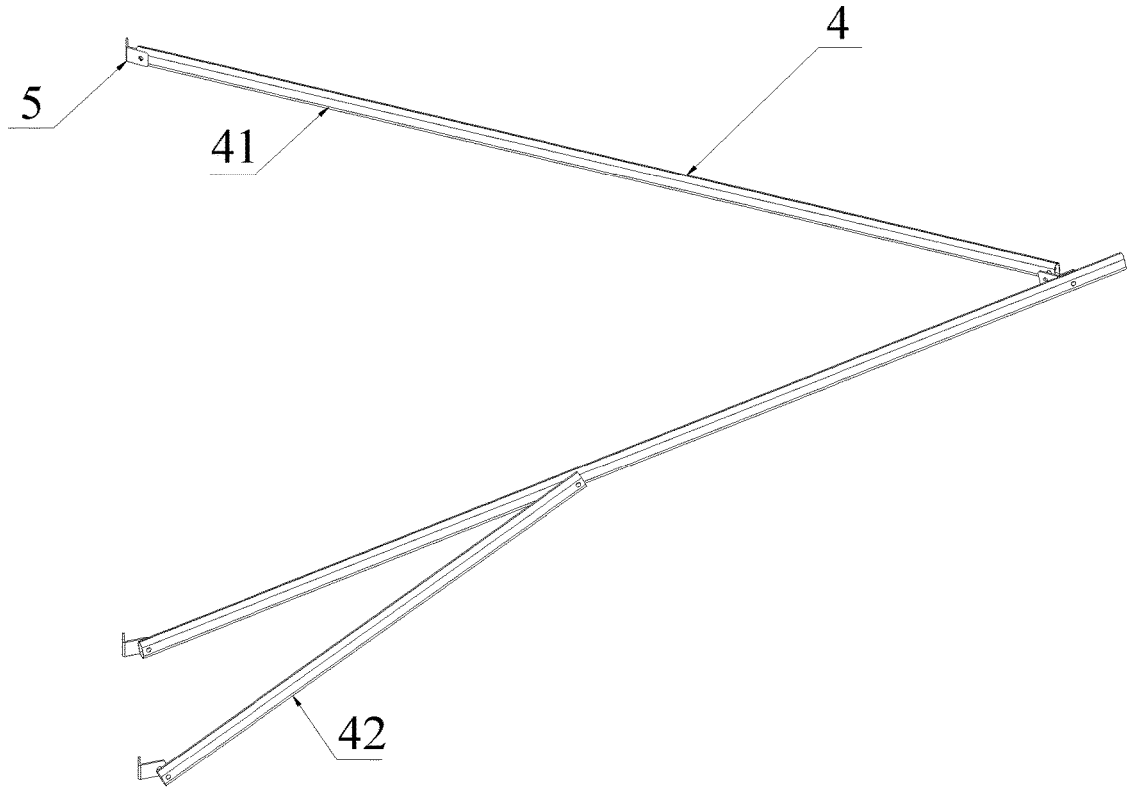
FIG. 4 is a solid diagram of an extended eaves assembly according to the disclosure.
Figure 5:
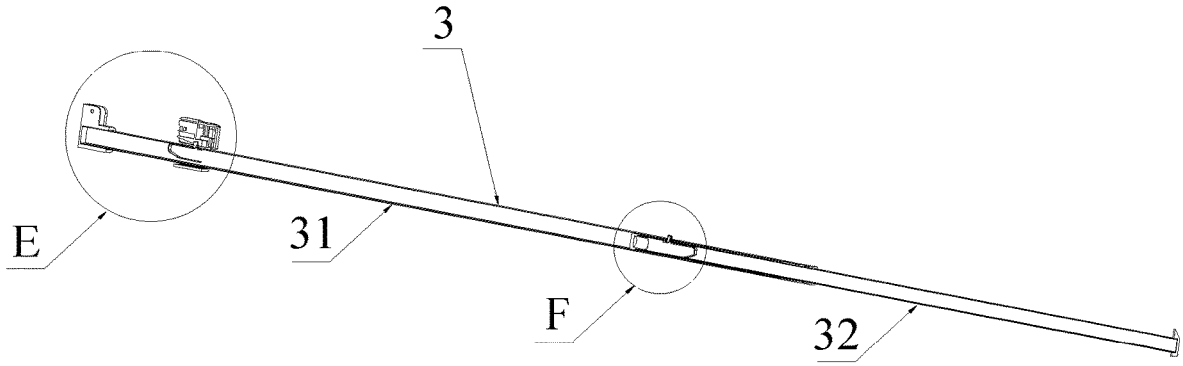
FIG. 5 is a sectional view of a vertical supporting assembly according to the disclosure.
Figure 6:
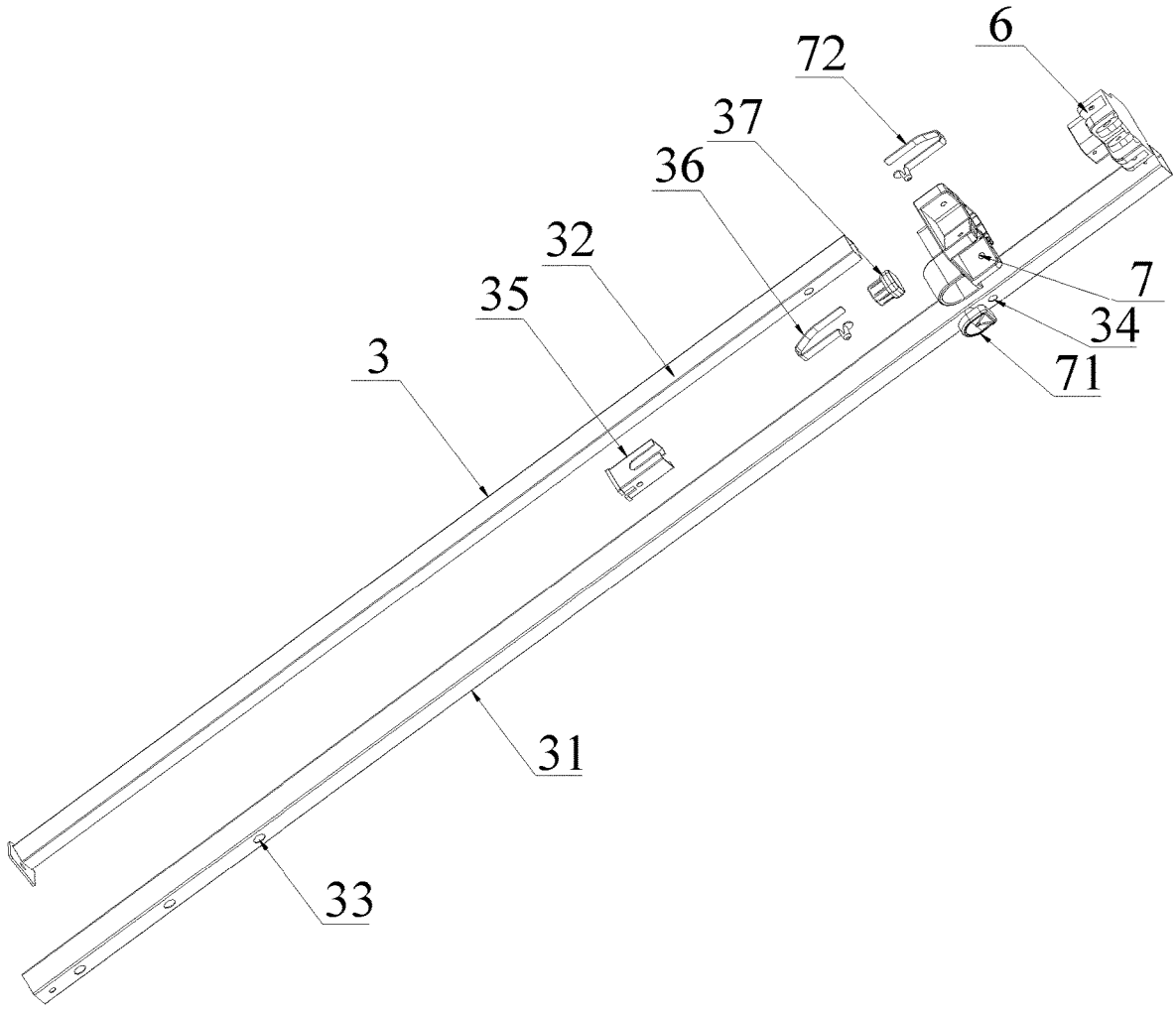
FIG. 6 is an exploded diagram of parts of a vertical supporting assembly according to the disclosure.
Figure 7:
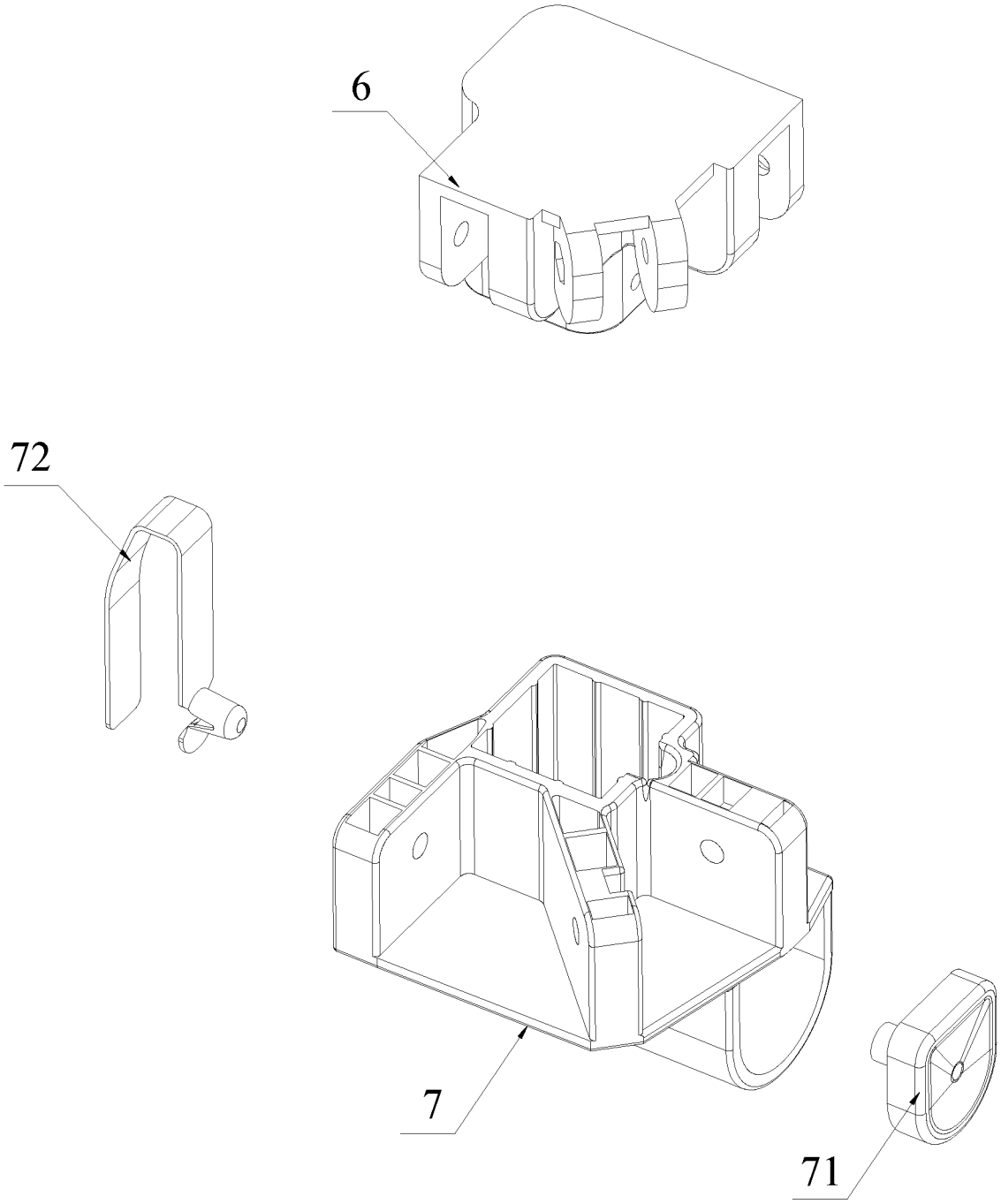
FIG. 7 is a solid diagram of a linking mechanism according to the disclosure.
Figure 8:
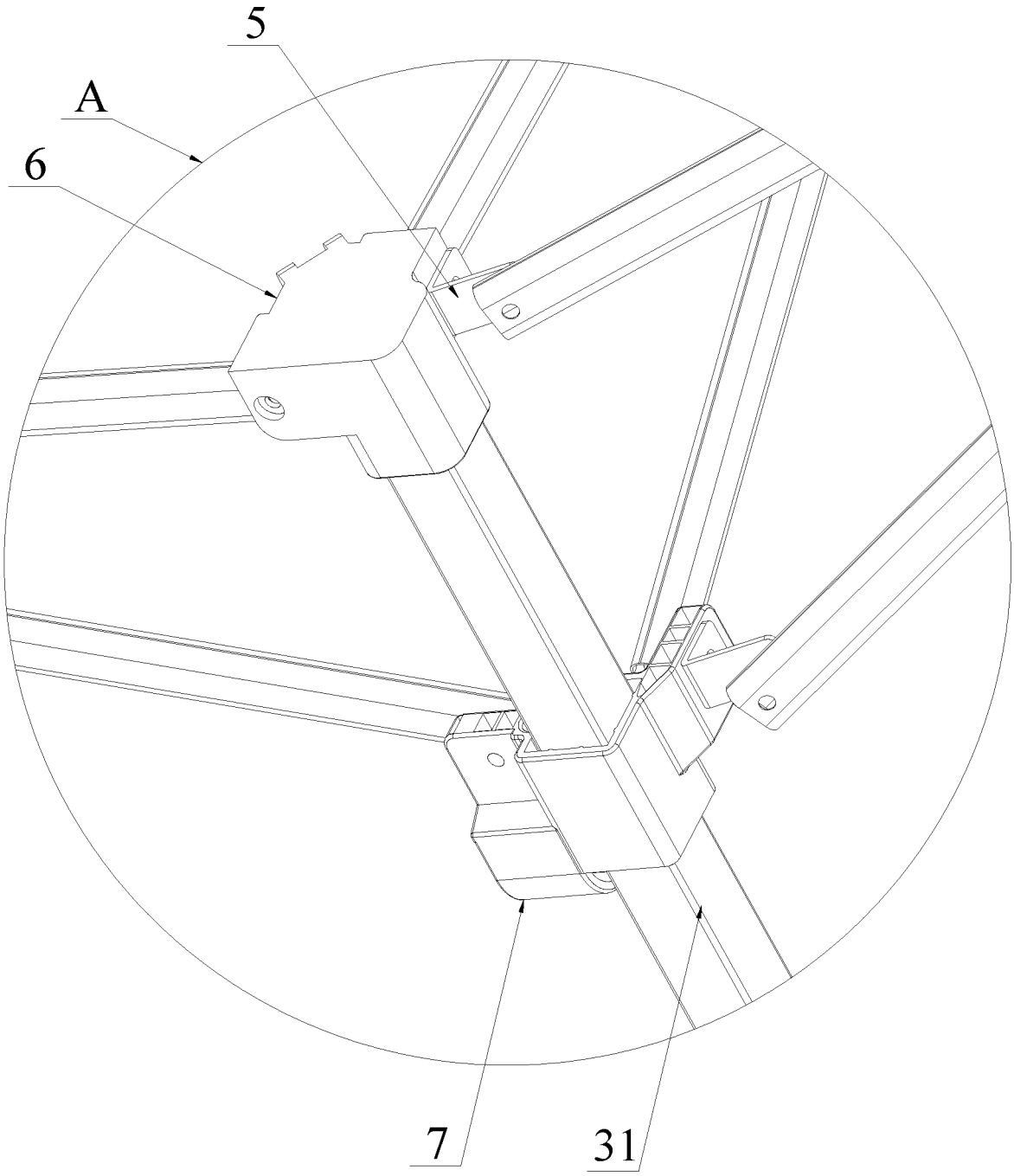
FIG. 8 is an enlarged structural diagram of portion A in FIG. 1 according to the disclosure.
Figure 9:
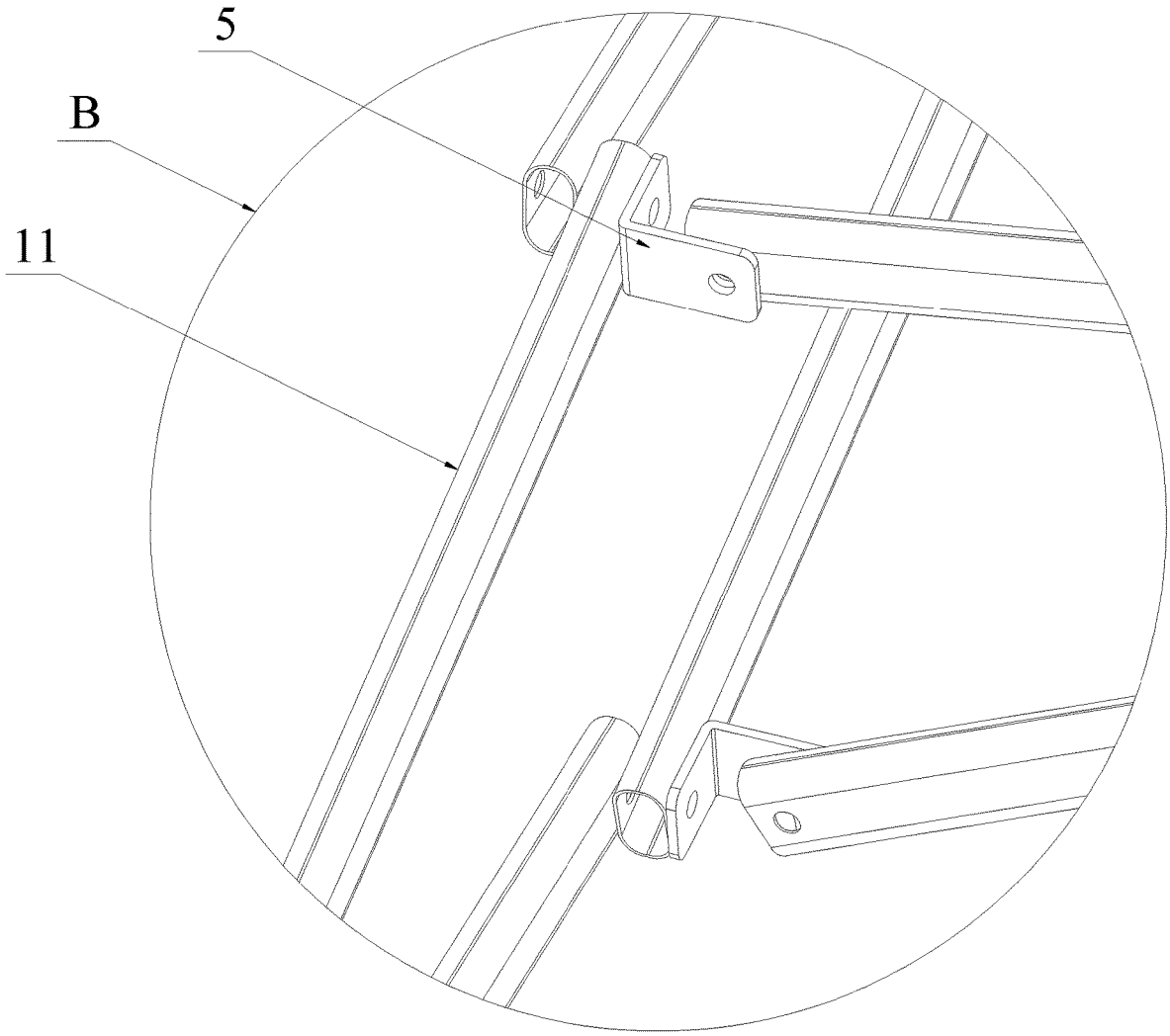
FIG. 9 is an enlarged structural diagram of portion B in FIG. 1 according to the disclosure.
Figure 10:
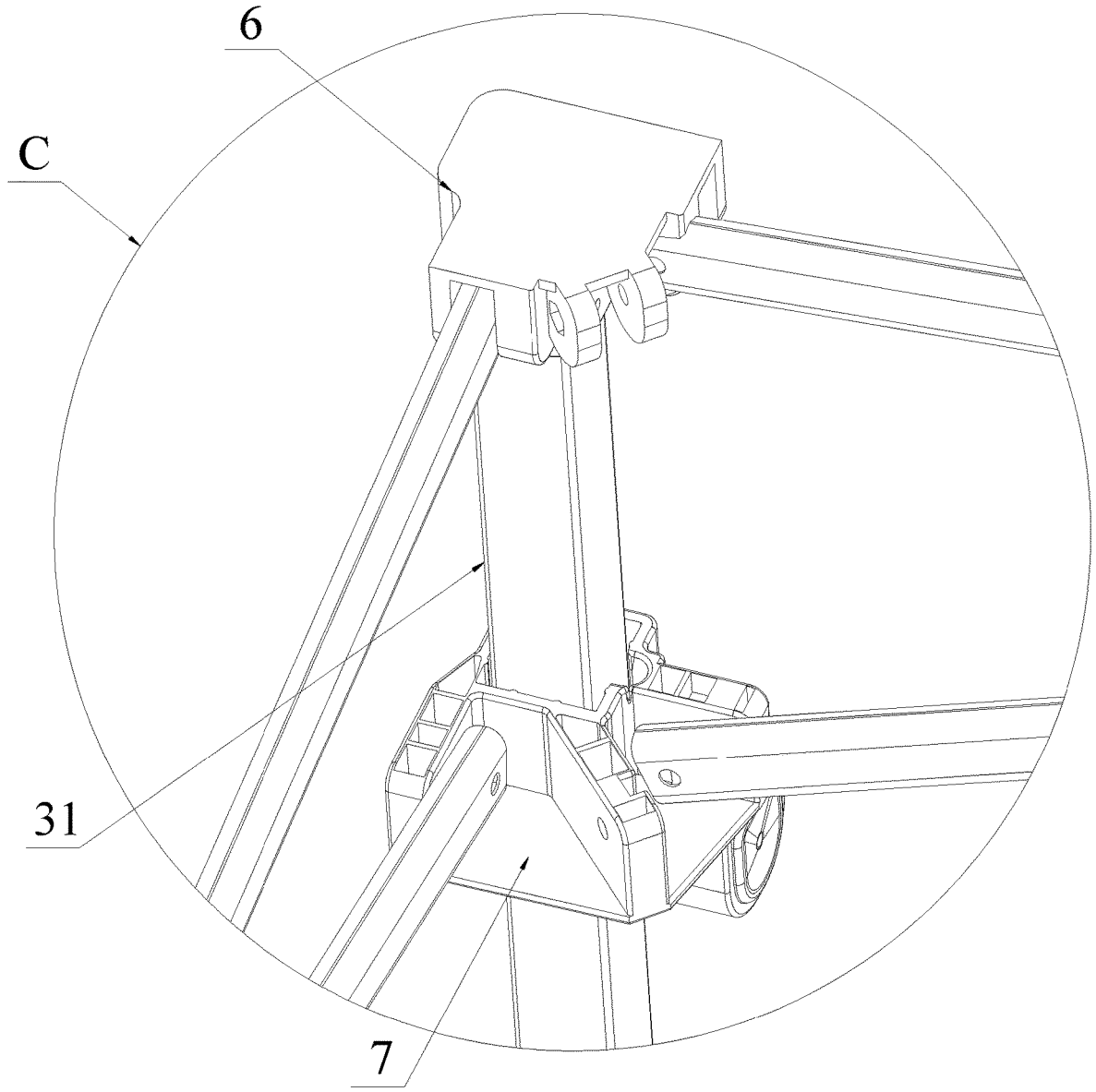
FIG. 10 is an enlarged structural diagram of portion C in FIG. 1 according to the disclosure.
Figure 11:
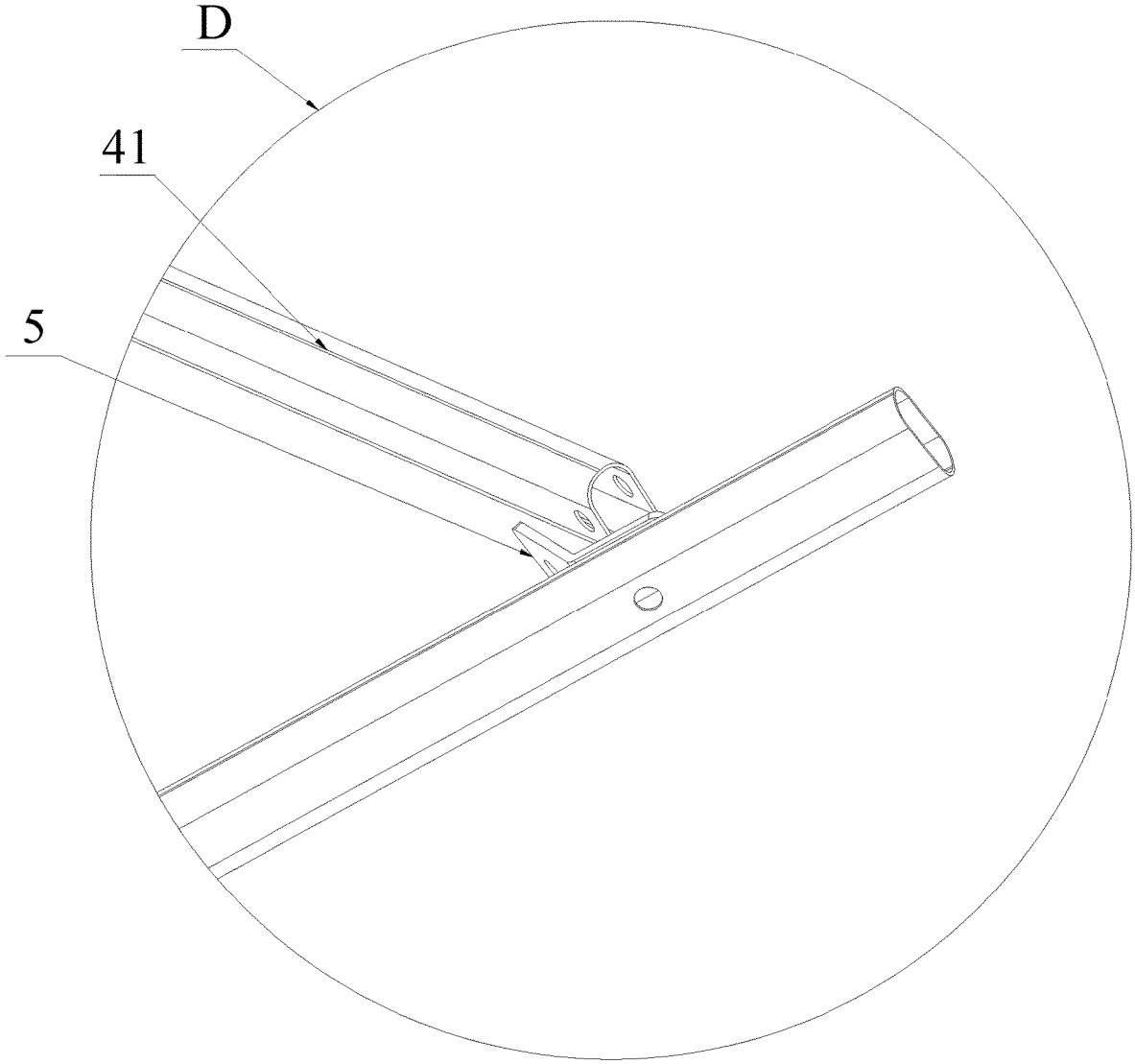
FIG. 11 is an enlarged structural diagram of portion D in FIG. 1 according to the disclosure.
Figure 12:
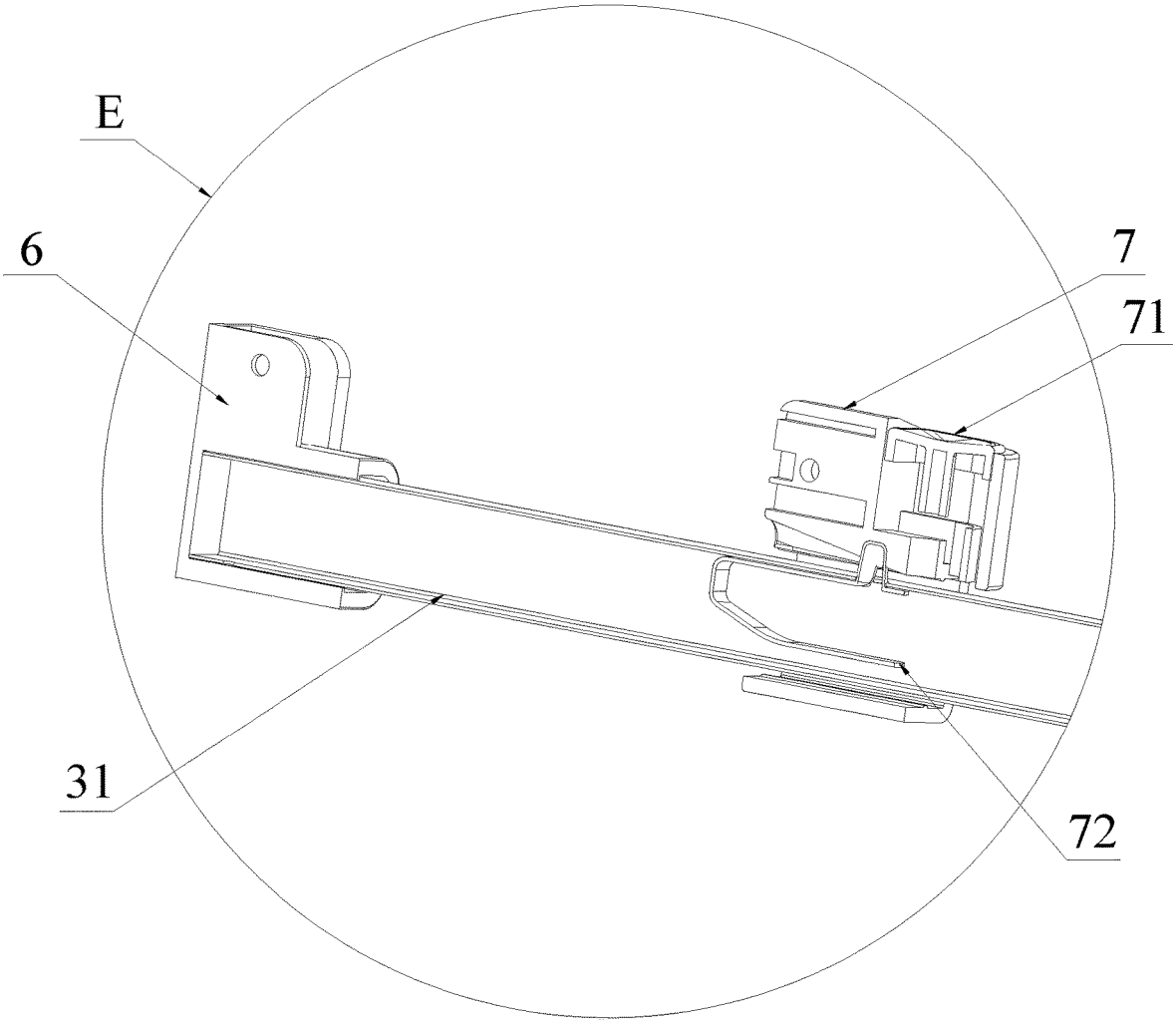
FIG. 12 is an enlarged structural diagram of portion E in FIG. 5 according to the disclosure.
Figure 13:
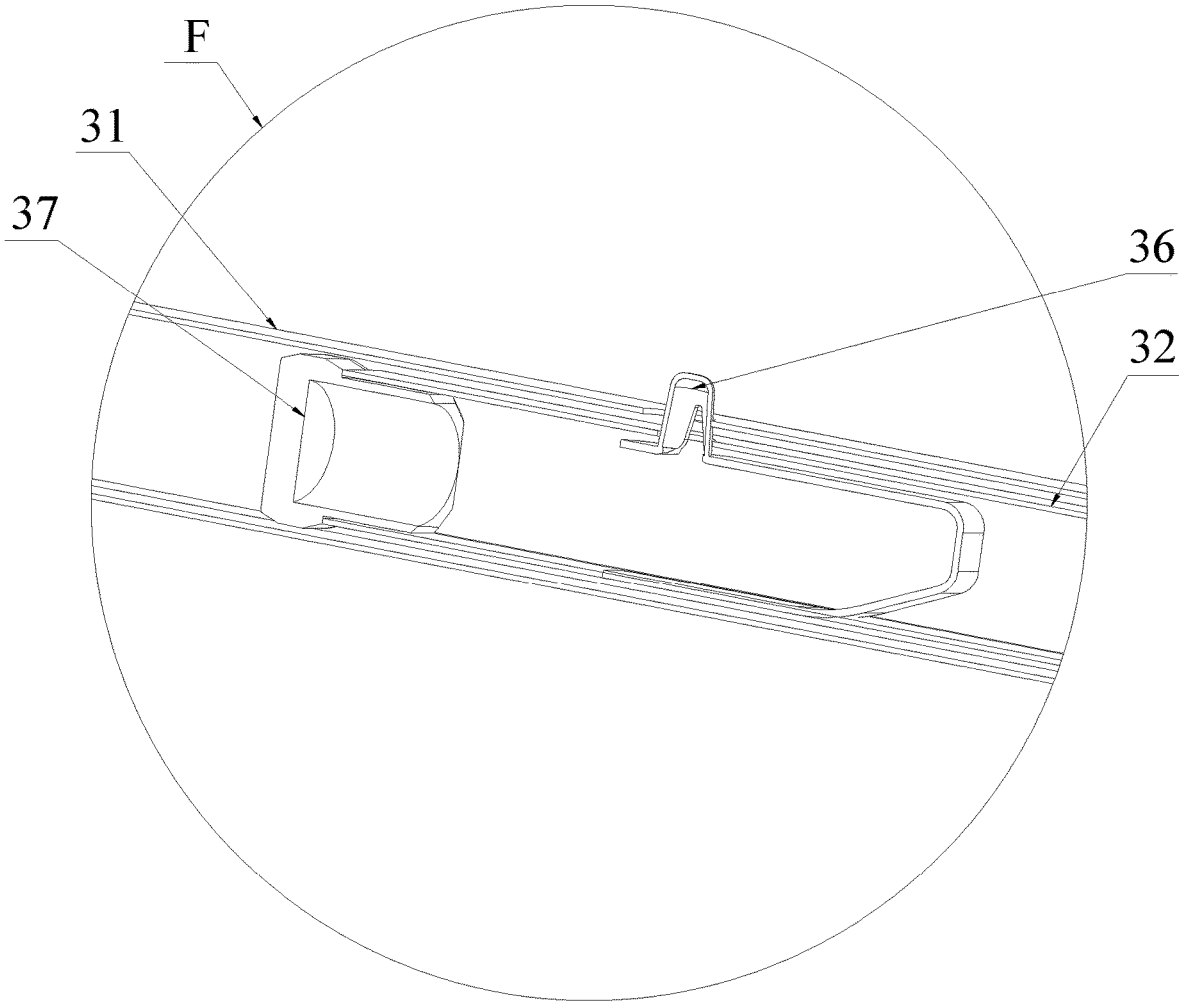
FIG. 13 is an enlarged structural diagram of portion F in FIG. 5 according to the disclosure.
Figure 14:
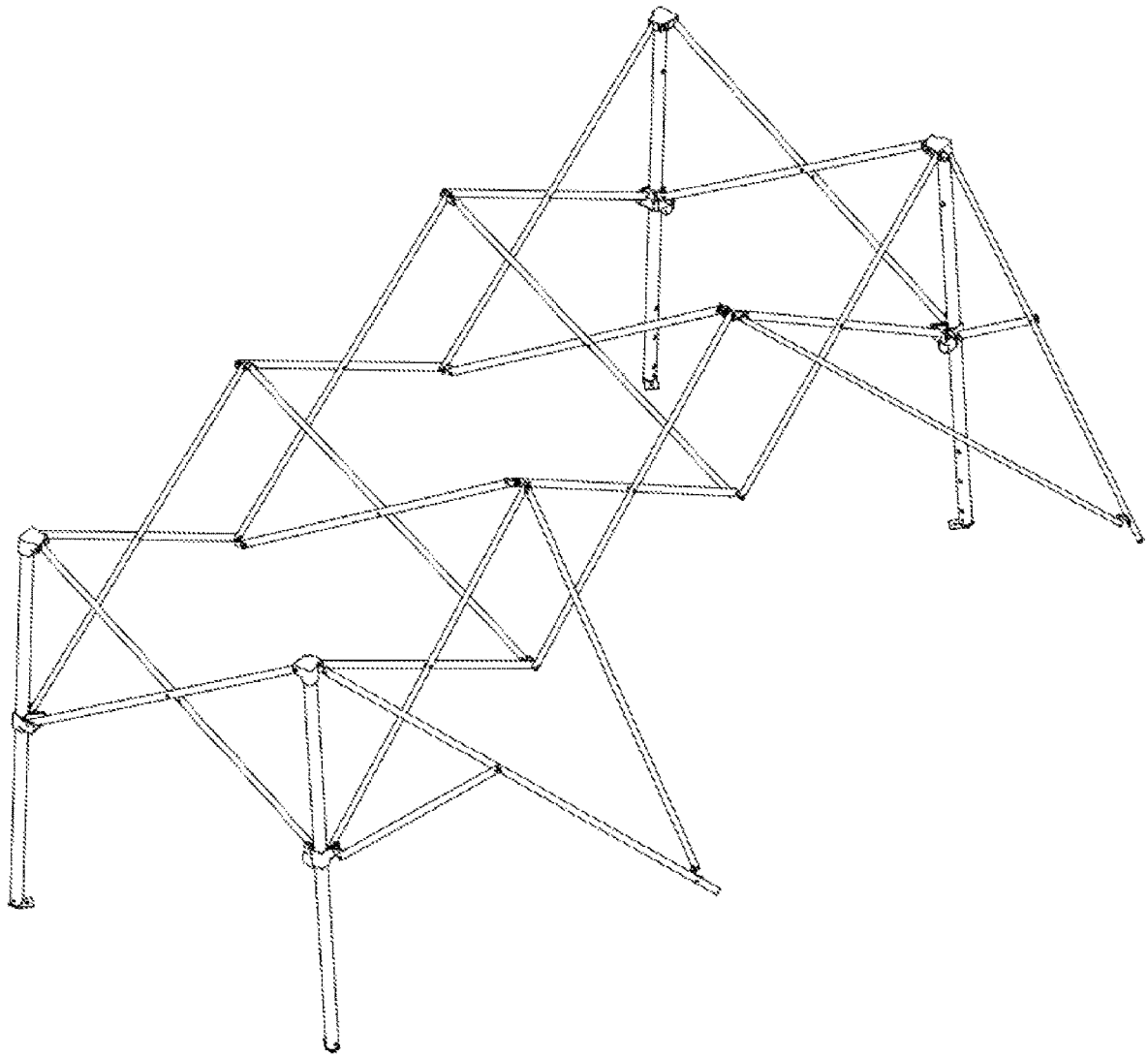
FIG. 14 is a solid diagram of folding an entire structure according to the disclosure.

In the figures, 1. transverse supporting assembly; 2. longitudinal supporting assembly; 3. vertical supporting assembly; 4. extended caves assembly; 5. connector; 6. fixed base; 7. movable base; 11. first connection rod; 21. second connection rod; 31. supporting sleeve rod; 32. inner supporting rod; 33. first limiting hole; 34. second limiting hole; 35. connection housing; 36. first leaf spring; 37, plug; 41. third connection rod; 42. fourth connection rod; 71, button; and 72. second leaf spring.

DETAILED DESCRIPTION

The implementation of the disclosure is described below with reference to particular specific embodiments. Other advantages and effects of the disclosure will be readily apparent to those skilled in the art from the contents disclosed in the description. Apparently, embodiments described are some embodiments rather than all embodiments of the disclosure. Based on the embodiments in the disclosure, all other embodiments derived by those of ordinary skill in the art without creative efforts fall within the scope of protection of the disclosure.

With reference to FIGS. 1-14, the disclosure provides a foldable tent integrated with eaves. The foldable tent integrated with eaves includes transverse supporting assemblies 1, where longitudinal supporting assemblies 2 are arranged between the transverse supporting assemblies 1, the transverse supporting assemblies 1 are movably connected to the longitudinal supporting assemblies 2, and one side of one transverse supporting assembly 1 is provided with an extended eaves assembly 4; vertical supporting assemblies 3 are arranged at end portions of the transverse supporting assemblies 1, the vertical supporting assemblies 3 include supporting sleeve rods 31 and inner supporting rods 32, one ends of the inner supporting rods 32 extend into the supporting sleeve rods 31, and the end portions of the transverse supporting assemblies 1 are provided with linking mechanisms.

The linking mechanisms include fixed bases 6 and movable bases 7, where the movable bases 7 include buttons 71 and second leaf springs 72, top ends of the supporting sleeve rods 31 are snapped into the fixed bases 6, the fixed bases are fixed to the supporting sleeve rods 31 through screws, the supporting sleeve rods 31 are snapped into the movable bases 7, and the movable bases 7 are slidably connected to the supporting sleeve rods 31; and the second leaf springs 72 are arranged inside the supporting sleeve rods 31, second limiting holes 34 are provided on one sides of the supporting sleeve rods 31, one ends of the second leaf springs 72 extend out of the second limiting holes 34, and the buttons 71 are arranged on one sides of the movable bases 7 to correspond to the second limiting holes 34.

In the implementation, when the tent is unfolded, as shown in FIG. 1, the transverse supporting assemblies 1 and the longitudinal supporting assemblies 2 are in an unfolded state. Moreover, the extended eaves assembly 4 is positioned in an obliquely-unfolded state. The second leaf springs 72 inside the supporting sleeve rods 31 pop out of the supporting sleeve rods 31. Accordingly, the second leaf springs 72 limit the movable bases 7, so as to fix the movable bases 7.

In order to realize the objective of supporting, the device employs the technical solution as follows: the transverse supporting assemblies 1 include a plurality of first connection rods 11, where the first connection rods 11 are cross-pivoted to form first connection rod assemblies, the first connection rod assemblies are movably connected to one another, and two ends of the transverse supporting assembly 1 are movably connected to the fixed bases 6 and the movable bases 7 individually. The first connection rods 11 are convenient to fold and unfold after the plurality of first connection rods 11 are connected to each other in a crossed manner.

In order to realize the objective of supporting, the device employs the technical solution as follows: the longitudinal supporting assemblies 2 include a plurality of second connection rods 21, and the second connection rods 21 are movably connected to each other in a crossed manner; and longitudinal supporting assemblies 2 positioned on inner sides are movably connected to the first connection rods 11 individually, and longitudinal supporting assemblies 2 positioned on outer sides are movably connected to the fixed bases 6 and the movable bases 7 individually. The second connection rods 21 play a role in supporting.

In order to realize the objective of extension, the device employs technical solution as follows: the extended caves assembly 4, the fixed bases 6, and the longitudinal supporting assemblies 2 are movably connected to connectors 5.

The extended caves assembly 4 includes third connection rods 41 arranged on two sides, and front ends of the third connection rods 41 are connected to each other in a crossed manner; and a third connection rod 41 on one side is movably connected to the first connection rod 11 through a connector 5, a third connection rod 41 on the other side is movably connected to the fixed base 6 through a connector 5, the third connection rod 41 on the one side is connected to a fourth connection rod 42 through a rotary shaft, and the fourth connection rod 42 is movably connected to the movable base 7 through a connector 5. Since the extended caves assembly 4 is in a triangular structure, the optimal stability is realized.

Illustratively, the front ends of the third connection rods 41 are connected to each other in the crossed manner through connectors 5, so as to connect the third connection rods 41 on the two sides into the triangular structure. Accordingly, mounting is flexible and convenient, and the stability is further improved.

In the embodiment, the transverse supporting assemblies 1 are movably connected to the longitudinal supporting assemblies 2, joints between the transverse supporting assemblies 1 and the longitudinal supporting assemblies 2 are provided with connectors 5, and the transverse supporting assemblies are movably connected to the longitudinal supporting assemblies through the connectors 5. Specifically, the longitudinal supporting assemblies 2 positioned on the inner sides are movably connected to the first connection rods 11 through the connectors 5 individually. Accordingly, the transverse supporting assemblies 1 and the longitudinal supporting assemblies 2 can be better mounted and connected.

In order to further realize the effect of sheltering from sun prevent rainwater from invading into the tent in rainy days, the other side of the one transverse supporting assembly 1 is further movably provided with an extended caves assembly 4. Through the arrangement of two extended caves assemblies 4, a sun sheltering area is further expanded. When the extended caves assembly 4 on one side is oblique upwards, the extended caves assembly 4 on the other side is oblique downwards, so that the rainwater can flow down along a slope of the tent.

In order to realize a required height, the device employs the technical solution as follows: joints between the inner supporting rods 32 and the supporting sleeve rods 31 are provided with connection housings 35, the inner supporting rods 32 are internally provided with first leaf springs 36, and one sides of the inner supporting rods 32 are provided with plugs 37; and the plugs 37 extend into the inner supporting rods 32, one sides of the supporting sleeve rods 31 are provided with a plurality of first limiting holes 33, and one ends of the first leaf springs 36 extend out of the first limiting holes 33. The first leaf springs 36 are pressed to be retracted into the inner supporting rods 32 and release the limitation on the inner supporting rods 32 and the supporting sleeve rods 31. The inner supporting rods 32 are pulled outwards to a proper height. In this case, one ends of the first leaf springs 36 extend out of the first limiting hole 33, so that the first leaf springs 36 inside the inner supporting rods 32 limit the inner supporting rods 32 and the supporting sleeve rods 31, and the objective of adjusting a height of the tent is realized accordingly.

A use process of the disclosure is as follows: when the disclosure is in use, in the case of unfolding the tent, as shown in FIG. 1, the transverse supporting assemblies 1 and the longitudinal supporting assemblies 2 are in the unfolded state. Moreover, the extended caves assemblies 4 are positioned in the obliquely-unfolded state. In addition, the second leaf springs 72 inside the supporting sleeve rods 31 pop out of the supporting sleeve rods 31. Accordingly, the second leaf springs 72 limit the movable bases 7, so as to fix the movable bases 7. The inner supporting rods 32 are pulled outwards to the proper height, so that the first leaf springs 36 inside the inner supporting rods 32 limit the inner supporting rods 32 and the supporting sleeve rods 31, and the objective of adjusting the height of the tent is realized accordingly. Then, the waterproof rain cloth is laid at a top of the tent, so as to unfold the tent. When the tent is required to be folded and stored, the buttons 71 are pressed to push the second leaf springs 72 to retract into the supporting sleeve rods 31. The movable bases 7 are pulled downwards to drive the transverse supporting assemblies 1 to move downwards, so that the transverse supporting assemblies 1, the longitudinal supporting assemblies 2, and the extended caves assemblies 4 are folded, and four vertical supporting assemblies 3 move close to one another. Moreover, the first leaf springs 36 are pressed to be retracted into the inner supporting rods 32, and in this case, the inner supporting rods 32 may be pushed into that supporting sleeve rod 31.

A using method for a foldable tent integrated with eaves is further disclosed in the disclosure. The using method for a foldable tent integrated with eaves includes.

- S1, transverse supporting assemblies 1 and longitudinal supporting assemblies 2 are unfolded.
- S2, an extended eaves assembly 4 on one side of one transverse supporting assembly 1 is unfolded to position the extended eaves assembly 4 in an oblique state.
- S3, vertical supporting assemblies 3 on one side corresponding to the extended eaves assembly 4 are stretched in response to determining that the extended eaves assembly 4 is positioned in an upwards-oblique state, so that the one side of the tent has a greater height than the other side; and vertical supporting assemblies 3 on one side corresponding to the extended eaves assembly 4 are retracted in response to determining that the extended eaves assembly 4 is positioned in a downwards-oblique state, so that the one side of the tent has a lower height than the other side.

Preferably, when the other side of the one transverse supporting assembly 1 is further movably provided with an extended eaves assembly 4, the using method further includes: one extended eaves assembly 4 is a downwards-oblique state, and a height of corresponding vertical supporting assemblies 3 is contracted simultaneously; and the other extended eaves assembly 4 is an upwards-oblique state, and a height of corresponding vertical supporting assemblies 3 is stretched simultaneously. Accordingly, an entire tent has one higher side and one lower side, the extended eaves assembly 4 on one side is positioned at an upper position, and the extended eaves assembly on the other side is positioned at a lower position. Therefore, the sun sheltering area is further expanded, and the rainwater is more likely to flow down along the slope of the tent.

What are described above are merely preferred embodiments of the disclosure. Those skilled in the art may modify the disclosure or modify the disclosure into equivalent technical solutions on the basis of the technical solutions described above. Therefore, any simple modification or equivalent substitution according to the technical solutions of the disclosure falls within the scope of protection claimed by the disclosure.

What is claimed is:

1. A foldable tent integrated with eaves, comprising transverse supporting assemblies (1), wherein longitudinal supporting assemblies (2) are arranged between the transverse supporting assemblies (1), the transverse supporting assemblies (1) are movably connected to the longitudinal supporting assemblies (2), and one side of one transverse supporting assembly (1) is movably provided with an extended eaves assembly (4); vertical supporting assemblies (3) are arranged at end portions of the transverse supporting assemblies (1), the vertical supporting assemblies (3) comprise supporting sleeve rods (31) and inner supporting rods (32), one ends of the inner supporting rods (32) extend into the supporting sleeve rods (31), and the end portions of the transverse supporting assemblies (1) are provided with linking mechanisms;

the linking mechanisms comprise fixed bases (6) and movable bases (7), wherein the movable bases (7) comprise buttons (71) and second leaf springs (72), top ends of the supporting sleeve rods (31) are snapped into the fixed bases (6), the fixed bases are fixed to the supporting sleeve rods (31), the supporting sleeve rods (31) are snapped into the movable bases (7), and the movable bases (7) are slidably connected to the supporting sleeve rods (31); and the second leaf springs (72) are arranged inside the supporting sleeve rods (31), second limiting holes (34) are provided on one sides of the supporting sleeve rods (31), one ends of the second leaf springs (72) extend out of the second limiting holes (34), and the buttons (71) are arranged on one sides of the movable bases (7) to correspond to the second limiting holes (34);

the extended eaves assembly (4), the fixed bases (6), and the longitudinal supporting assemblies (2) are movably connected to connectors (5);

the extended eaves assembly (4) comprises third connection rods (41) arranged on two sides, and front ends of the third connection rods (41) are connected to each other in a crossed manner; and a third connection rod (41) on one side is movably connected to the first connection rod (11) through a connector (5), a third connection rod (41) on the other side is movably connected to the fixed base (6) through a connector (5), the third connection rod (41) on the one side is connected to a fourth connection rod (42) through a rotary shaft, and the fourth connection rod (42) is movably connected to the movable base (7) through a connector (5).

2. The foldable tent integrated with eaves according to claim 1, wherein the transverse supporting assemblies (1) comprise a plurality of first connection rods (11), the first connection rods (11) are cross-pivoted to form first connection rod assemblies, the first connection rod assemblies are movably connected to one another, and two ends of the transverse supporting assemblies (1) are movably connected to the fixed bases (6) and the movable bases (7) individually.

3. The foldable tent integrated with eaves according to claim 1, wherein the longitudinal supporting assemblies (2) comprise a plurality of second connection rods (21), and the second connection rods (21) are movably connected to each other in a crossed manner; and longitudinal supporting assemblies (2) positioned on inner sides are movably connected to the first connection rods (11) individually, and longitudinal supporting assemblies (2) positioned on outer sides are movably connected to the fixed bases (6) and the movable bases (7) individually.

4. The foldable tent integrated with eaves according to claim 1, wherein the front ends of the third connection rods (41) are connected to each other in a crossed manner through connectors (5).

5. The foldable tent integrated with eaves according to claim 1, wherein the longitudinal supporting assemblies (2) positioned on the inner sides are movably connected to the first connection rods (11) through connectors (5) individually.

6. The foldable tent integrated with eaves according to claim 1, wherein joints between the inner supporting rods (32) and the supporting sleeve rods (31) are provided with connection housings (35), the inner supporting rods (32) are internally provided with first leaf springs (36), and one sides of the inner supporting rods (32) are provided with plugs (37); and the plugs (37) extend into the inner supporting rods (32), one sides of the supporting sleeve rods (31) are provided with a plurality of first limiting holes (33), and one ends of the first leaf springs (36) extend out of the first limiting holes (33).

7. The foldable tent integrated with eaves according to claim 1, wherein the other side of the one transverse supporting assembly (1) is also movably provided with an extended eaves assembly (4).

* * * * *